US006695301B1

(12) United States Patent
Tratar

(10) Patent No.: US 6,695,301 B1
(45) Date of Patent: Feb. 24, 2004

(54) METHOD AND SYSTEM FOR FEEDING AND TRANSPORTING DOCUMENTS

(75) Inventor: David Brian Tratar, Dearborn, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/334,494

(22) Filed: Dec. 30, 2002

(51) Int. Cl.[7] ..... B65H 7/02; B65H 85/00; B65H 1/00

(52) U.S. Cl. ..... 271/3.13; 271/258.01; 271/161; 250/559.4; 399/371; 358/488

(58) Field of Search ..... 271/258.01, 3.13, 271/161; 162/198; 250/559.3, 559.4, 559; 209/576; 399/371; 358/488; 700/229; B65H 7/02, 85/00, 1/00

(56) References Cited

U.S. PATENT DOCUMENTS 3,834,289 A * 9/1974 Behrens et al. ..... 271/265.04
3,927,876 A * 12/1975 Wojtowicz et al. ..... 271/10.11
4,555,103 A * 11/1985 Larson ..... 271/35
5,308,052 A * 5/1994 Roch et al. ..... 271/2
5,360,316 A * 11/1994 O'Mara et al. ..... 414/798.9
5,419,546 A 5/1995 Chen et al.
5,437,375 A 8/1995 Chen et al.
5,439,506 A 8/1995 Chen et al.
5,509,648 A 4/1996 Chen et al.
5,671,919 A 9/1997 Chen et al.
5,848,784 A 12/1998 Tranquilla
5,908,191 A 6/1999 Chen et al.
6,199,854 B1 3/2001 Tranquilla et al.

FOREIGN PATENT DOCUMENTS

JP 8-208130 * 8/1996 ..... B65H/85/00

* cited by examiner

*Primary Examiner*—Donald P. Walsh
*Assistant Examiner*—Kenneth W Bower
(74) *Attorney, Agent, or Firm*—Lise A. Rode; Mark T. Starr; Brooks & Kushman P.C.

(57) ABSTRACT

A system and method for feeding and transporting documents are provided. The system includes a feeder stage including a hopper, a feeder and a separator. The hopper includes a hopper wall extending toward the feeder with a waterfall step along the hopper wall and with the stack of documents engaging the hopper wall including the waterfall step to form a pocket area over a limited distance extending from the waterfall step along the hopper wall toward the feeder. A photo edge detector located in the pocket area faces the stack of documents such that when a feeding document trailing edge passes the waterfall step, the trailing edge is detected by the photo edge detector while in the pocket area. The system further includes a transport stage downstream of the feeder stage for receiving the fed documents.

6 Claims, 2 Drawing Sheets

METHOD AND SYSTEM FOR FEEDING AND TRANSPORTING DOCUMENTS

BACKGROUND OF THE INVENTION

1. Field of the Invention

The present invention relates to systems and methods for feeding and transporting documents and to detecting a document trailing edge.

2. Background Art

A typical system for feeding and transporting documents includes a feeder and a separator in the document feeding portion of the system, and a series of roller pairs or belts in the document transporting portion of the system. In the feeding portion of the system, the feeder acts with the separator to feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. The separator may be a wheel, but also may take other forms such as a belt. Further, the components in the transporting portion of the system may take a variety of forms. The systems also include a component in the document feeding portion of the system that nudges documents into the nip between the feeder and the separator. A suitable nudger may be a nudger wheel, but may take other forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

Workers will understand the importance of detecting the leading and trailing edges of documents, and the gaps between them, as they pass through the feeding system and the transport system beyond. Many operations to be performed upon the documents (for example, printing, reading, imaging and so forth) are required to be performed at specific locations along the length of the document, and so it is very important for the system to be able to detect when the leading or trailing edge of a document appears at a specific point. From this data, the system can extrapolate its necessary understanding of where the document is, how fast it is traveling, and when and where specific operations should be performed upon it.

Similarly, it is just as important for the system to understand the lengths and locations of gaps between documents as it is for it to understand the lengths and locations of the documents themselves. It will be understood that document processing systems seek to produce the highest possible throughput rates, and therefore, workers seek to minimize gaps between successive documents. At a given transport speed, a gap is a unit of time in the operation of the system which is not occupied by a document, and is therefore lost to productive processing. At the same time, systems often require a discrete and controlled time interval between documents, for example, to transmit data gathered from the previous document, or to reset mechanisms after processing the previous document, and the optimum gap is usually dependent upon the length of the previous document. The longer the previous document (generally speaking) the longer the gap required after it before the system can be ready to commence processing the next document.

Workers therefore always seek to reduce the gaps between documents to the smallest possible consistent with all system functions, and for system functions, gaps are most usually dealt with as time measurements rather than measurements of physical distance. In order to best measure and manage both document lengths and the gaps between them for the optimum throughput, workers will understand that it is advantageous to be able to detect both leading and trailing edges of documents as early in their processing as possible, and preferably, during the feeding process, before any other processes are to be performed upon them.

Ideally, such a system would measure the position of the edges of the document in the feed hopper even before it is fed. However, documents can vary widely in overall length. For example, if we consider a high-speed document processing machine such as the Unisys NDP2000, the specified range of document length is 4.25"–9.25", or a range greater than 100% between shortest and longest. There is a need to detect trailing edges of unequal length documents, while in motion, before documents leave the feeder area to sense for overlapping and aid in controlling spacing between documents. To meet this need a detector capable of detecting over a wide possible range of document trailing edge positions would be required. It is found that a single detector, at a suitable fixed location in the feed hopper consistent with the shortest possible document length, serves the desired function.

In order to perform operations on documents that depend on document position, leading and/or trailing document edges are detected depending on the operation to be performed. A known device for detecting document edges is the photo edge detector. U.S. Pat. No. 5,848,784 describes the use of an edge detector. The edge detector is suitable for some applications, but may be sensitive to, for example, printing on the documents and/or document thickness and/or opacity. There is a need to overcome the optical sensor's inability to differentiate between the trailing edge of documents and printing, fold lines, holes or other document characteristics that look like a document edge.

Workers will understand that photo edge detectors can be and are used to detect both leading and trailing edges of documents, but they can only function upon individual documents, for example when traveling singly in a document track. Since they rely for their function upon the interruption of a beam of light, traditional photo edge detector applications are unsuitable for use in a feed hopper which contains many documents in a stack because the document trailing edge may be difficult to identify particularly against the document stack and other document characteristics that look like a document edge. Such sensors in traditional applications have been used to detect leading edges of documents as they leave the stack in the feed hopper, but cannot be used to detect trailing edges until the trailing edge has entirely separated from the stack of documents behind it in the feed hopper.

For the foregoing reasons, there is a need for an improved system and method for feeding and transporting documents that detect a document trailing edge at a known location with a photo edge detector while it is still within the feed hopper.

SUMMARY OF THE INVENTION

It is, therefore, an object of the present invention to provide an improved system and method for feeding and transporting documents that detect, based on a photo edge detector, a document trailing edge at a known location within a feed hopper, while the document whose trailing edge is to be detected is still in the process of being fed from the stack of documents behind it.

In carrying out the above object, a system for feeding and transporting documents is provided. Each document has a leading edge and a trailing edge. The system comprises a feeder stage, a photo edge detector and a transport stage. The feeder stage includes a hopper, a feeder and a separator. The feeder acts with the separator to feed documents singly, in order, from a stack of documents in the hopper. The hopper includes a hopper wall extending toward the feeder with a waterfall step along the hopper wall and with the stack of documents engaging the hopper wall including the waterfall step to form a pocket area. The pocket area is formed over a limited distance extending from the waterfall step along the hopper wall toward the feeder. The photo edge detector is located in the pocket area and faces the stack of documents such that a feeding document slides between the stack of documents and the hopper wall. The feeding document trailing edge passes the waterfall step and is detected by the photo edge detector while in the pocket area. The transport stage is downstream of the feeder stage for receiving the fed documents.

By adding a waterfall step in the hopper wall at a specific height and an optical sensor at a specific distance from this step, a void or pocket area is created where documents in the stack are outside of the optical sensor's viewing range. As the trailing edge of the fed document clears the step, it snaps down into viewing range of the sensor signaling the trailing edge without adding unwanted drag on the document. Advantageously, this technique does not require additional moving mechanical parts or opposing forces on the documents as they move toward the feeder in the hopper. The photo edge detector may suitably be implemented as a single optical sensor, however, an array of photo edge detectors could alternatively be located in the pocket area. The array would provide more information for determining the feeding document trailing edge position and would accommodate documents of varying thicknesses that result in pocket areas of varying sizes.

At a more detailed level, the present invention comprehends control logic in communication with the photo edge detector or detectors for determining the feeding document trailing edge position based on the photo edge detector or detectors, and a control device. The control device performs a document processing function in response to direction from the control logic.

Further, in carrying out the present invention, a method for feeding and transporting documents is provided. Each document has a leading edge and a trailing edge. The method comprises providing a feeder stage, providing a photo edge detector, and providing a transport stage. The feeder stage includes a hopper, a feeder and a separator. The feeder acts with the separator to feed documents singly, in order, from a stack of documents in the hopper. The hopper includes a hopper wall extending toward the feeder with a waterfall step along the hopper wall and with the stack of documents engaging the hopper wall including the waterfall step. This forms a pocket area over a limited distance extending from the waterfall step along the hopper wall toward the feeder. The photo edge detector is located in the pocket area and faces the stacked documents. A feeding document slides between the stack of documents and the hopper wall with the feeding document trailing edge passing the waterfall step and being detected by the photo edge detector while in pocket area. The transport stage is downstream of the feeder stage for receiving the fed documents.

At a more detailed level, the method may alternatively utilize an array of photo edge detectors located in the pocket area and includes the steps of determining the feeding document trailing edge position based on the photo edge detector(s) and performing a document processing function in response to the feeding document trailing edge position.

The advantages associated with embodiments of the present invention are numerous. For example, embodiments of the present invention detect a document trailing edge at a known location by sensing the document trailing edge with an optical sensor. Embodiments of the present invention are suitable for use in a feed hopper. Detecting the trailing edge position while the document is still in the feeder allows operations to be performed on the document, as well as other operations to be performed while the document is still in the feeder. In addition, knowing the trailing edge position allows a system to know when to perform operations on subsequent documents. Many document processing products could benefit from embodiments of the present invention. For example, copiers, fax machines, sheet feeders for computer printers, automatic teller machines, and document image scanners are just a few examples of products that could benefit from embodiments of the present invention.

The above objects and other objects, features, and advantages of the present invention are readily apparent from the following detailing description of the preferred embodiment when taken in connection with the accompanying drawings.

DETAILED DESCRIPTION OF THE PREFERRED EMBODIMENT

Figure 1:
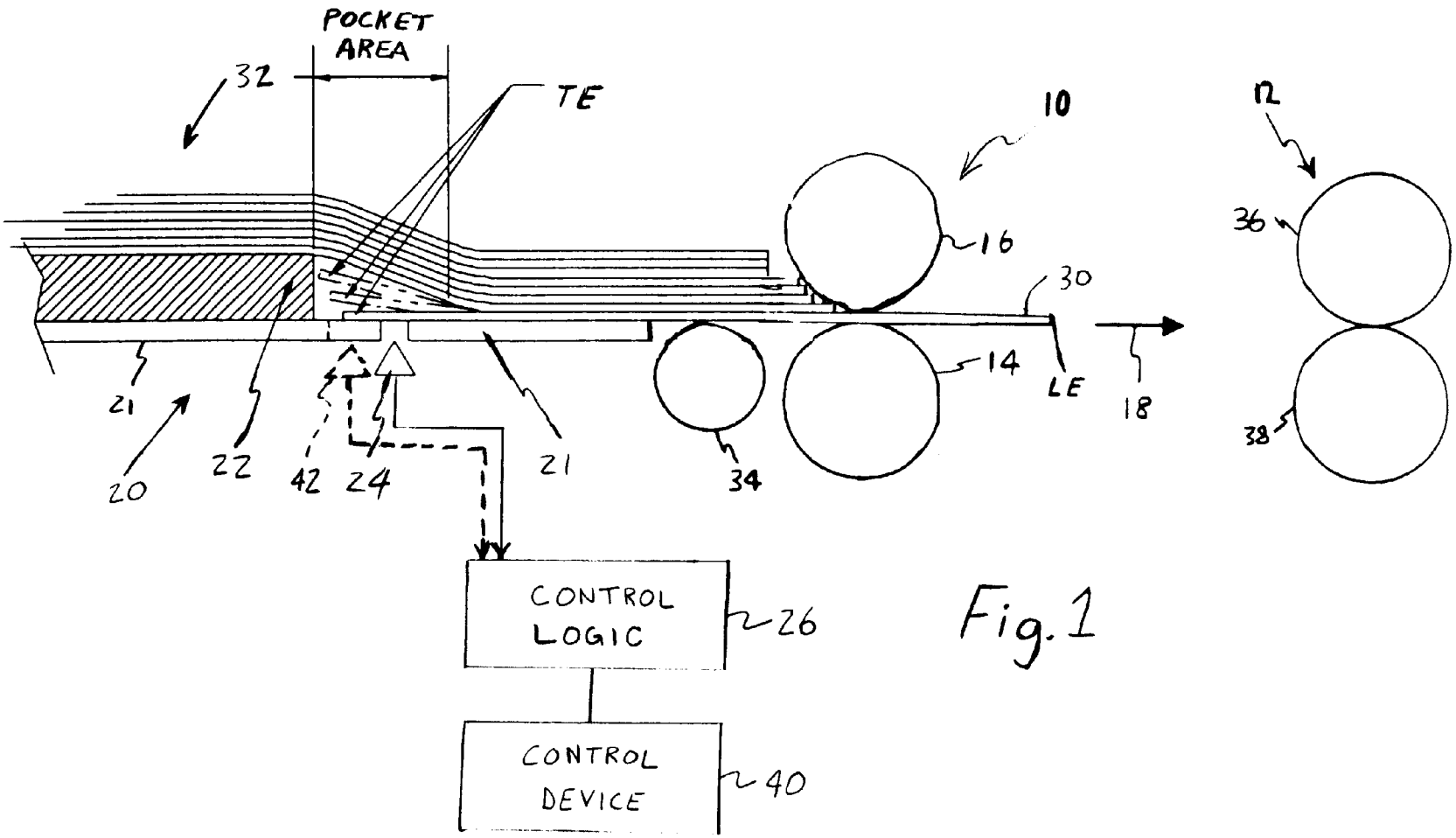
FIG. 1 illustrates an exemplary system for feeding and transporting documents in accordance with the present invention.

FIG. 1 illustrates a system for feeding and transporting documents. The system includes a feeder stage 10 and a transport stage 12. Feeder stage 10 includes a feeder 14 and a separator 16. Transport stage 12 is downstream of feeder stage 10, with arrow 18 pointing in the downstream direction. A document leading edge LE is the more downstream edge while the trailing edge TE is the more upstream edge. Feeder stage 10 further includes hopper 20. Hopper 20 includes a hopper wall 21 extending toward feeder 14 with a waterfall step 22 along hopper wall 21. A stack 32 of documents engages hopper wall 21 including waterfall step 22 to form a pocket area over a limited distance extending from waterfall step 22 along hopper wall 21 toward feeder 14. A photo edge detector 24 is directed toward a fixed location upstream of feeder 14 in the pocket area and faces stack 32 of documents. A feeding document slides between stack 32 of documents and hopper wall 21 with the feeding document trailing edge TE passing waterfall step 22 and being detected by photo edge detector 24 while in the pocket area. In FIG. 1, motion of the trailing edge TE is shown in phantom.

By adding waterfall step 22 in hopper wall 21 at a specific height and photo edge detector or optical sensor 24 at a specific distance from step 22, the pocket area is created where documents in stack 32 are outside of the sensor viewing range of photo edge detector 24. As the feeding document trailing edge TE clears step 22, it snaps down into viewing range of photo edge detector 24 signaling the trailing edge without adding unwanted drag on the documents, requiring moving mechanical parts, or requiring opposing forces on the documents as they move toward feeder 14 from hopper 20. This arrangement overcomes the typical optical sensor inability to differentiate between the trailing edge of documents and printing, fold lines, holes or other document characteristics that look like a document edge.

Control logic 26 is configured to detect a signal from sensor 24 indicating when a document trailing edge TE passes. Control logic 26 also provides an output signal, which is provided to a control device 40. Control logic 26 may direct control device 40 to perform document processing functions based on knowledge of the trailing edge position. Further, control logic 26 may perform system diagnostics based on received signals.

Document stack 32 is shown adjacent to separator 16 and includes first document 30 among other documents in stack 32, with the trailing edge of first document 30 being in the pocket area. The components shown in FIG. 1 are exemplary, and alternative arrangements are possible as known to those skilled in the art. For example, the feeder is shown as a feed wheel 14, but may take other forms. The separator is shown as a separator wheel 16, but also may take other forms such as a belt. As shown, feed wheel 14 rotates clockwise, driven by its own motor (not shown), and separator or retarder wheel 16 is fixed or runs slowly relative to the speed of the feed wheel 14. Further, the components in transporting portion 12 may take a variety of forms as known to those skilled in the art, but for convenience of understanding are shown as an accelerator idler wheel 36 and an accelerator drive wheel 38 that rotates clockwise. The system may also include a suitable nudging device such as nudger wheel 34.

With continuing reference to FIG. 1, feed wheel 14, separator 16, and nudger 34 are typical elements for feeding documents singly from a document stack. Downstream accelerator wheel pair 36, 38 accepts the document from feed wheel 14 and separator 16. The accelerator drive wheel 38 may or may not be driven by the same motor that drives feed wheel 14 and may run at the same or higher peripheral speed than feed wheel 14. Further, feed wheel 14 may or may not have a greater grip on the document than the accelerator wheel pair, depending upon the application. Feed wheel 14 may or may not have attached to it a device to indicate relative feed wheel position.

The system shown in FIG. 1 detects, or registers the presence or arrival, of trailing edge TE of document 30 at a known location in the pocket area based upon detection from photo edge detector 24. Detecting the trailing edge of a moving document while still in the feed hopper has many advantages. For example, using any appropriate technique known in the art, the total length of the document may be determined, earlier in the feeding cycle, thus allowing various other document processing functions to be performed upon the documents sooner, faster, and/or at lower cost.

It is appreciated that characteristics of the documents in document stack 32 affect the size of the pocket area. Detector 24 is placed at a specific distance from waterfall step 22 so as to be located in the pocket area to detect the passing of the trailing edge. Some embodiments of the present invention may utilize an array of photo edge detectors. As shown in FIG. 1, photo edge detector 42 is optional and also provides information to control logic 26.

Further, it is appreciated by those skilled in the art that embodiments of the present invention may be applied in multiple locations upon the same item. For example, the system could be applied at various points in the height of the item being fed to obtain a reliable signal of the trailing edge that is not affected by the presence of holes or tears in the item. This is an addition to the possibility of using an array of photo edge detectors to get sequential signals of the trailing edge of the item which could be used to calculate the speed of the item or to accommodate for varying documents that create different pocket sizes.

Figure 2:
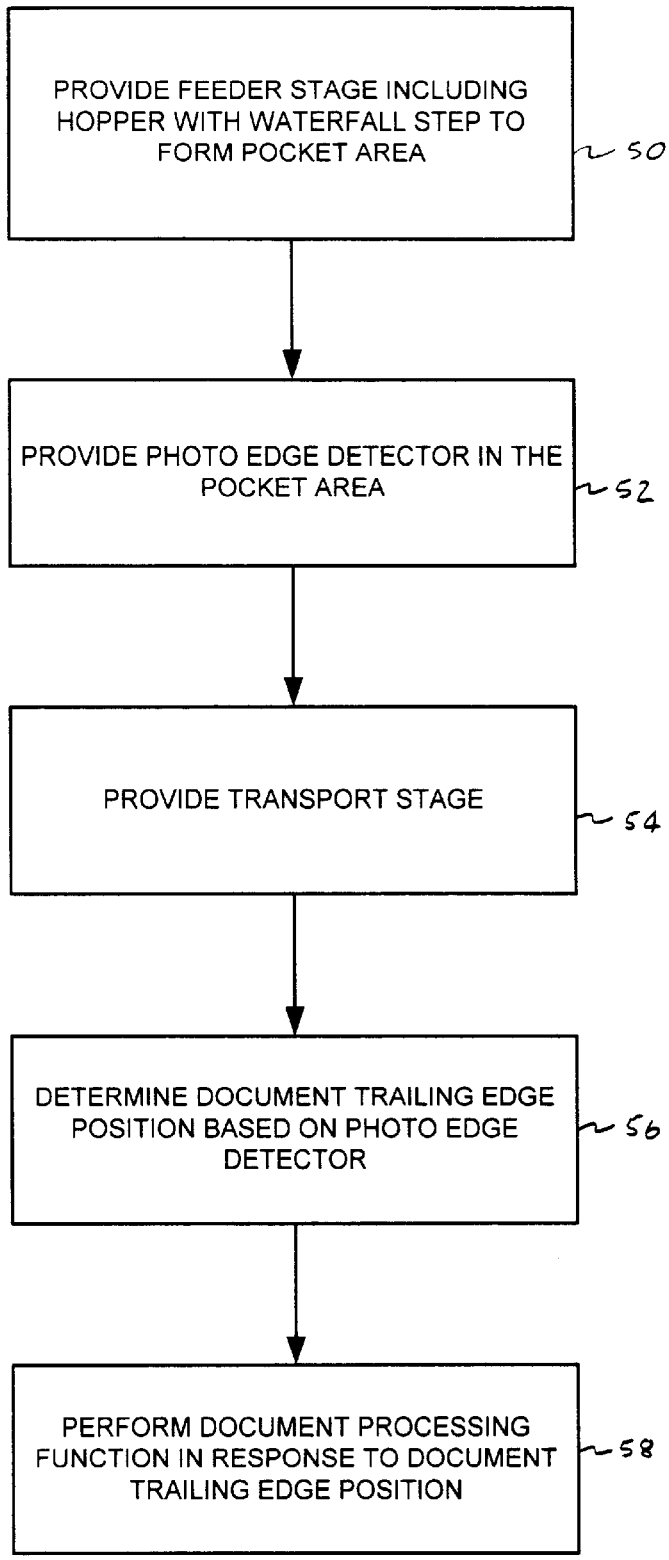
FIG. 2 is a block diagram illustrating a method of the present invention.

FIG. 2 is a block diagram illustrating a method of the present invention. At block 50, a feeder stage including a hopper with a waterfall step to form a pocket area is provided. At block 52, a photo edge detector is provided in the pocket area. At block 54, a transport stage is provided. At block 56, document trailing edge position is determined based on signals from the photo edge detector. At block 58, a document processing function is performed in response to the document trailing edge position.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a hopper, a feeder and a separator wherein the feeder acts with the separator to feed documents singly, in order, from a stack of documents in the hopper, the hopper including a hopper wall extending toward the feeder with a waterfall step along the hopper wall and with the stack of documents engaging the hopper wall including the waterfall step to form a pocket area over a limited distance extending from the waterfall step along the hopper wall toward the feeder;

a photo edge detector located in the pocket area and facing the stack of documents such that a feeding document slides between the stack of documents and the hopper wall with the feeding document trailing edge passing the waterfall step and being detected by the photo edge detector while in the pocket area; and a transport stage downstream of the feeder stage for receiving the fed documents.

2. The system of claim 1 further comprising:

an array of photo edge detectors located in the pocket area.

3. The system of claim 1 further comprising:

control logic in communication with the photo edge detector for determining the feeding document trailing edge position based on the photo edge detector; and a control device for performing a document processing function in response to direction from the control logic.

4. A method for feeding and transporting documents, each document having a leading edge and a trailing edge, the method comprising:

providing a feeder stage including a hopper, a feeder and a separator wherein the feeder acts with the separator to feed documents singly, in order, from a stack of documents in the hopper, the hopper including a hopper wall extending toward the feeder with a waterfall step along the hopper wall and with the stack of documents engaging the hopper wall including the waterfall step to form a pocket area over a limited distance extending from the waterfall step along the hopper wall toward the feeder;

providing a photo edge detector located in the pocket area and facing the stack of documents such that a feeding document slides between the stack of documents and the hopper wall with the feeding document trailing edge passing the waterfall step and being detected by the photo edge detector while in the pocket area; and providing a transport stage downstream of the feeder stage for receiving the fed documents.

5. The method of claim 1 further comprising:

providing an array of photo edge detectors located in the pocket area.

6. The method of claim 1 further comprising:

determining the feeding document trailing edge position based on the photo edge detector; and performing a document processing function in response to the feeding document trailing edge position.

* * * * *